US009834950B2

(12) United States Patent
Carlos De Alvarenga et al.

(10) Patent No.: US 9,834,950 B2
(45) Date of Patent: Dec. 5, 2017

(54) EARTH AUGER AND POLE MACHINE, AND POLE INSTALLATION METHOD

(71) Applicant: VALE S.A., Rio de Janeiro (BR)

(72) Inventors: Sebastião Carlos De Alvarenga, Itabira (BR); Magno Papa Vitalino, Itabira (BR); Airton De Souza, Pedro Leopoldo (BR); Áquila Capele Caldeira Pereira, Nova Era (BR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 15/094,910

(22) Filed: Apr. 8, 2016

(65) Prior Publication Data

US 2016/0298355 A1 Oct. 13, 2016

(30) Foreign Application Priority Data

Apr. 9, 2015 (BR) ..... 102015007997

(51) Int. Cl.

| | |
|---|---|
| ***E02F 3/06*** | (2006.01) |
| ***E04H 12/34*** | (2006.01) |
| ***E21B 7/00*** | (2006.01) |
| ***E21B 7/02*** | (2006.01) |
| *E02F 5/20* | (2006.01) |

(52) U.S. Cl.

CPC ..... *E04H 12/347* (2013.01); *E21B 7/005* (2013.01); *E21B 7/027* (2013.01); *E02F 5/20* (2013.01)

(58) Field of Classification Search

CPC ... E02F 3/06; E02F 3/627; E02F 3/786; E02F 3/961; E04H 12/347; E04H 17/263

See application file for complete search history.

(56) References Cited

U.S. PATENT DOCUMENTS

| | | | | |
|---|---|---|---|---|
| 4,809,788 A * | 3/1989 | Nelson | E21B 7/02 173/28 |
| 7,004,262 B1 * | 2/2006 | Voichoskie | E04H 17/263 173/28 |
| 2005/0161654 A1 | 7/2005 | Ancell | |

FOREIGN PATENT DOCUMENTS

| | | |
|---|---|---|
| BR | MU 7602012-6 U | 8/1998 |
| DE | 10 2004 018 385 A1 | 11/2005 |

* cited by examiner

*Primary Examiner* — Mark Beauchaine

(74) *Attorney, Agent, or Firm* — Arent Fox LLP

(57) ABSTRACT

Described herein is an earth auger and pole machine for automated installation of poles in earth banks of access roads to open-pit mines. The earth auger and pole machine is fitted with a mechanic boom comprised of a first link and a second link. The first link has an end attached to a base fixed to a conveyor vehicle, and the other end coupled to the second link. The second link comprises a magazine for loading the poles, an auger system to drill the ground, and an installer to place the poles into the hole. This document also describes a method for installing poles in sequence by using the earth auger and pole machine.

22 Claims, 7 Drawing Sheets

EARTH AUGER AND POLE MACHINE, AND POLE INSTALLATION METHOD

CLAIM OF PRIORITY

This application is based upon and claims the benefit of priority to Brazilian Patent Application No. 102015007997-4, filed Apr. 9, 2015. The disclosure of the prior application of which is hereby incorporated in its entirety by reference.

FIELD OF THE INVENTION

This invention consists of an earth auger and pole machine for open pit mines and, following, a pole installation method.

BACKGROUND OF THE INTENTION

The invention refers to an earth auger and pole machine for access roads towards open-pit mines.

Access roads are those roads built to allow vehicles and equipment to access an open-pit mine. They are built on the side borders of the mines, tapering into a helical path until they reach the bottom of the deposit (see FIG. 1).

In general, an access road is always located at five meters in vertical from the lower access road; see distance in FIG. 2.

The access road 15 does not have proper lighting, which makes it difficult from noticing the road border limits at night. In order to prevent accidents and improve the visibility of the road borders, soil banks are built, 16, of about 2.5 meters height (see distance d' in FIG. 2) and, in the upper side of these banks, poles are installed, 13.

Poles are signaling devices used to show the limit of the access road to open-pit mines. They are made of PVC tubes and labeled with reflective film to improve better viewing at night.

Poles are installed in a sequence, on the upper face of earth banks. Poles help the vehicle operator who is traveling through the access road.

In the prior art, poles are installed manually by workers. Such installation is conducted in two steps: the drilling step and the prop installation step.

The drilling step is performed by a worker in the access road bank, by using a backhoe (similar to the equipment showed in BRMU7602012-6). This step demands intense physical strength from the worker, and is quite unsatisfactory with regard to the ergonomics of the operation.

The second step is the pole introduction into the hole produced in the first step. This process is conducted by a worker too, and is performed manually without any aid of any piece of device. Therefore, the process, once more, demands intense physical strength and shows low ergonomic conditions as it is necessary to load and manually insert the pole into the hole.

Both steps take place in the upper side of the bank, thus exposing the workers to high altitude, which poses a high risk of falling to these individuals, making the installation of poles not only exhausting in physical and ergonomics terms, but also hazardous due to the possibility of leading a worker to fall from 17.5 meters height (d+d').

Moreover, during the installation of poles, the workers are exposed to weather conditions in the location and can receive a lot of sunlight, get wet in the rain or breath the dust from the road. All this exposure may impair the physical integrity of these employees.

We can conclude, then, that the method taken in the prior art brings great hazards to workers and demands great physical strength from them. Also, because the method is performed manually, it requires a long time to finish the installation of each pole.

The prior art includes technologies that are set for automation of the utility poles installation operation. However, as shown below, these technologies are not capable of solving the specific issue of installing poles in open-pit mines. One of these technologies is covered by document US20050161654.

The technology covered by document US20050161654 shows a vehicle similar to a Bobcat® loader, adapted and used for installing utility poles. The vehicle is equipped with a type of mechanical arm comprised of a support for poles and hydraulic auger.

The mechanical arm is responsible for movement during pole installation. This installation procedure is also split into two steps, the drilling and installation.

The drilling step is conducted by the hydraulic auger coupled to the mechanical arm. Which, in turn, is forced against the ground by moving the mechanical arm, thus creating a hole in the floor.

The pole placement is conducted by a support for poles also installed on the mechanical arm. The vehicle moves towards the pole positioned in a truck or on the ground and through the movement of the mechanical arm, making the pole support contact the pole and grab it during the operation.

With the pole attached to the support, the vehicle moves towards the hole location in order to place it. This, in turn, is also performed by moving the mechanical arm by inserting the pole end into the inner hole part.

This process demands a long time of execution as it would not be possible to allow, for instance, installing a sequence of poles. Provided that the vehicle needs to move towards the pole, then to the hole, at every installation of utility pole, thereby becoming ineffective in placing these elements in sequence.

The process shown in US20050161654 does not seem applicable, either, to installation of poles in earth banks, as the vehicle displayed there is not able to reach the upper side of earth banks.

Also, the vehicle is not adapted to off-road movement and it is due to the little distance between the vehicle floor and the ground, which prevents it from traveling in rough roads, i.e, the roads similar to the access road to the open-pit mine.

The prior art also comprises a pole insertion technique for road borders. Such technique is covered by document DE102004018385. However, this technology is also ineffective for installing poles in open-pit mines.

The German document shows a vehicle equipped with an automated pole placement machine and flags for marking the road. The vehicle comprises a pole compartment where they are in upright position and a pole placement machine made of two separate devices, i.e, a loader and an installer.

The loader serves to transporting poles from the compartments to the installer through an automated mechanical device that rotates and enables the device end to reach the pole positioned in the compartment, and back to the installer. The loader has a support at the machine end that serves to support the pole during transportation together with the mechanic device, and let it go when contacting the installer. In the installer, the pole is positioned upright and pushed against the ground by a hydraulic hammer.

The movement carried out by the loader is done during the displacement from a pole installation point to another, so that a pole is always provided to the installer at the installation time required.

The compartment also spins, making the pole to always be at reach by the loader and providing quick loading for installation of poles in sequence.

This process is conducted on the same plane as the vehicle's, thus preventing the placement of poles in high places such as earth banks of open-pit mines. Still, the poles are pushed against the ground without prior drilling, thus preventing the installation of poles as, generally, they are made of PVC tubes, which implies low resistance to axial pressure.

For this reason, the technique DE10200401838 is not applicable to the placement of poles in open-pit mines provided that it can not be used to signaling high places and is not capable of installing poles with low structural resistance.

Based on the techniques shown here, in the prior art there is no technique for installing poles in open-pit mines that is able to install, in an automated way, the poles on the top of earth banks 16. There is not, either, a method for pole placement that enables these to be installed quickly and in sequence. Finally, there is no automated method of pole placement that is able to avoid breaking the elements structure.

GOALS OF THE INVENTION

This invention aims to provide an earth auger and pole machine for installing poles in an automated manner in open-pit mine earth banks.

This invention also aims to provide an earth auger and pole machine for installing poles in sequence in open-pit mine earth banks.

Finally, the invention also targets a method for installing poles in sequence, in open-pit mine earth banks.

BRIEF DESCRIPTION OF THE DRAWINGS

The present invention is best described in detail based on the respective figures.

DETAILED DESCRIPTION OF THE INVENTION

Figure 1:
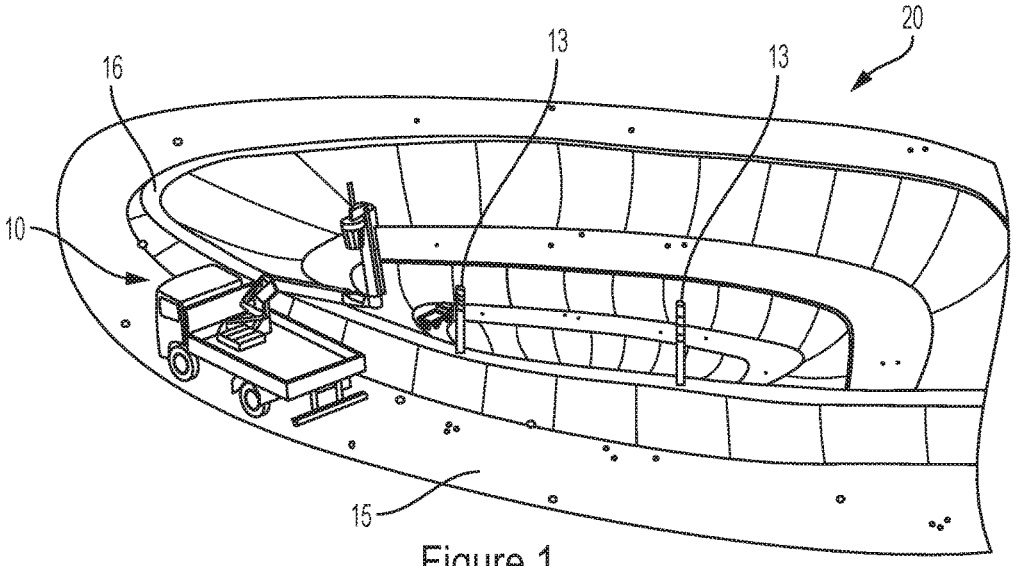
FIG. 1 is a bird's eye view of the open-pit mine.
Figure 2:
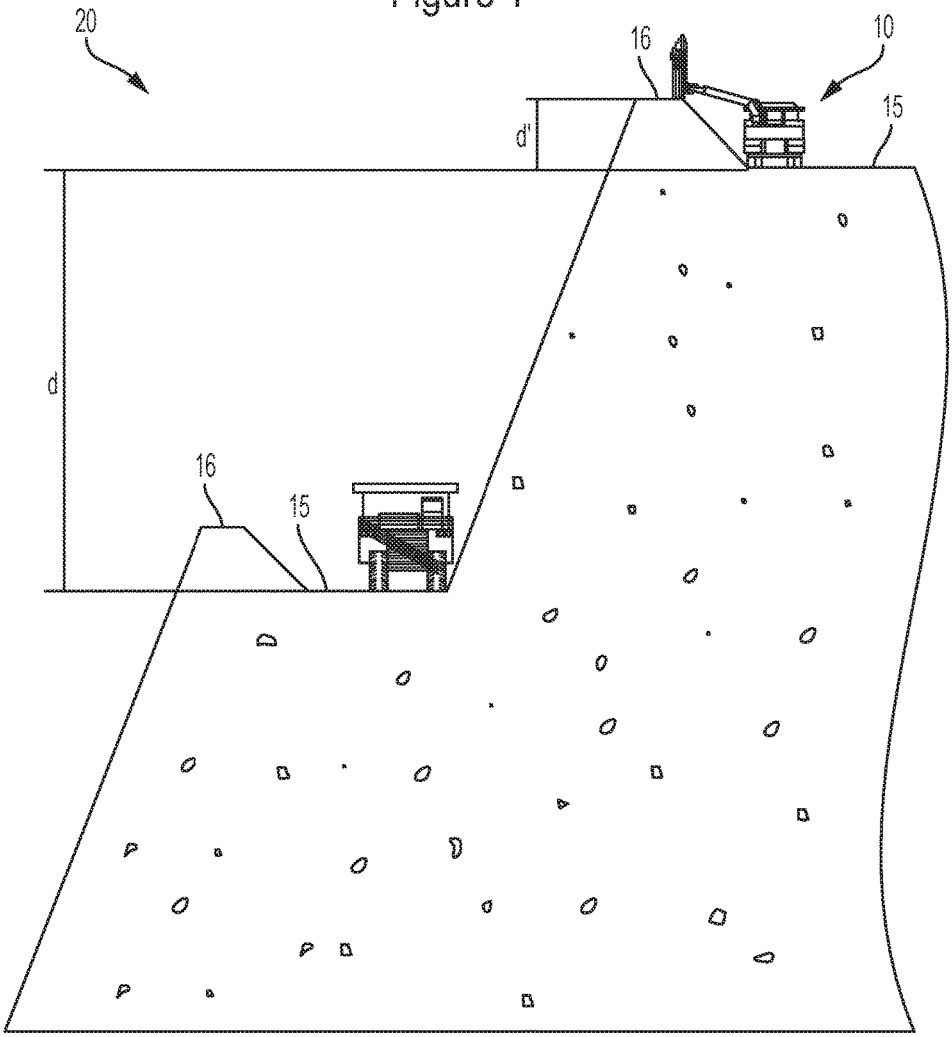
FIG. 2 is a front section of the open-pit mine.

This invention refers to an earth auger and pole machine 10 for access roads 15 towards open-pit mines 20. This invention also refers to a method for installing poles 13 in earth banks 16 from open-pit mines 20.

Access roads 15 are those roads built to allow vehicles and equipment to access an open-pit mine 20. They are built on the side borders of the open-pit mine 20, tapering and making a helical path so as to enable the access to the bottom of the deposit. See FIG. 1.

The access road 15 have no light poles, which makes it difficult to notice the road border limits 15 at night. In order to prevent accidents, earth banks 16 of about 2.5 m height are built in both borders.

On the upper side of earth banks 16, the poles 13 are placed. Poles 13 are signaling poles used to show the limit of the access road 15 to open-pit mines 20.

Placement of poles 13 in the prior art is carried out manually, thus taking a long time to be completed. The placement also poses risk of workers falling and demands an excessive physical strength.

Seeking a solution to these problems, the earth auger and pole machine 10 hereto allow the poles 13 to be installed automatically, thus saving the worker's physical strength and risk of falling presented by the prior art.

The earth auger and pole machine 10 comprises: a hydraulic auger 7, a supporting magazine 4, a pneumatic installer 12, a mechanical boom 2, a vehicle for transportation 14 and a command control 17. Each component is described separately below for better understanding.

The mechanic arm 2 is set to move and support the supporting magazine 4, the pneumatic installer 12, and the hydraulic auger 7 during the placement of poles 13. The arm 2 offers a wide degree of freedom to components 4, 7, 12, making it possible that poles 13 are installed on high spots, such as the upper face of earth banks 16 (see FIG. 3) and retract them when not in use.

The degrees of freedom to the mechanic arm 2 are provided by movement joints that ensure supporting and moving all components 4, 7, 12 while conveying and installing the poles 13.

The mechanic arm 2 is provided with two links; the first link is link 18, and the second one, link 3. The second link 3 has one end attached into the first link 18 and a free end. The second link 3 serves to support components 4, 7, 12 during installation of poles 13.

The first link 18 is set to enable the second link 3 reach the upper face of the bank 16. The first link 18 can pitch and lurch, i.e, rotate vertically and rotate horizontally. See FIG. 7.

The vertical movement performed by the first link 18 can draw a 90° angle from the baseline 1, while in the horizontal movement, the first link 18 can rotate 360° from the baseline 1.

The hydraulic auger 7 is set to make 100 mm diameter, 800 mm deep holes in 500 mm to 3000 mm high earth banks to place the poles 13. This comprises an auger 8 coupled to a support 9 that levels it during the drilling operation.

Such support 9 is installed in a trail 11 located in the radial face of the second link 3 to the mechanic arm 2, so that the auger 8 is arranged in parallel to the second link 3 of the mechanic arm 2.

The trail 11 enables the hydraulic auger 7 to travel a linear movement while drilling the ground, thus allowing the auger 8 to come in and out of the ground to drill it.

Auger 8 is driven by a hydraulic engine located above the support 9, serving only to rotate the element. The linear movement performed by the bearer 9 is carried out by means of a hydraulic cylinder which forces it to the upper or lower end of the rail 11, see FIG. 9.

The magazine 4 is set to store and arrange the poles 13 for their installation. The magazine 4 consists of a circular base 5 provided with slots 6 responsible for storing the poles 13.

The circular base 5 has a radial side parallel arranged in relation to the radial side of the second link 3 of the mechanical arm 2. This, in turn, is coupled to the second link 3 of the mechanical arm 2 by means of a joint.

Figure 10:
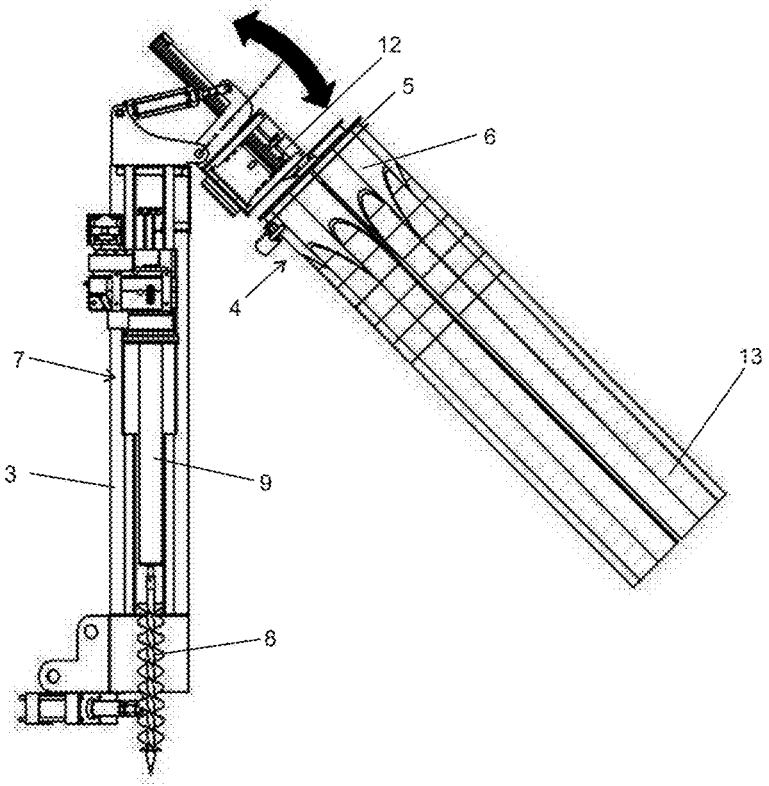
FIG. 10 pictures a front view of magazine opening.

This joint is responsible for performing an opening movement between the magazine 4 and the second link 3, see FIG. 10. This movement causes the two elements to define an angle of 90° between their structures.

The slots 6 are arranged perpendicularly to the flat side of the circular base 5, so that the poles 13 also stay perpendicularly arranged in relation to that structure. The poles 13 are arranged in parallel with the auger 8 of the hydraulic auger 7, for rapid installation after drilling.

The flat side of the circular base 5, where the slots 6 are installed, is set to perform a rotary movement in the longitudinal axis. This movement is carried out so that all the poles 13 contained in slots 6 can reach the installation point, similar to turning a drum of a gun after firing.

The installation point is located in the circular base of the flat side 5 of the magazine 4. The installation point is the point where it occurs the alignment of the slots 6 with the pneumatic cylinder comprised of the pneumatic installer 12.

Figure 12:
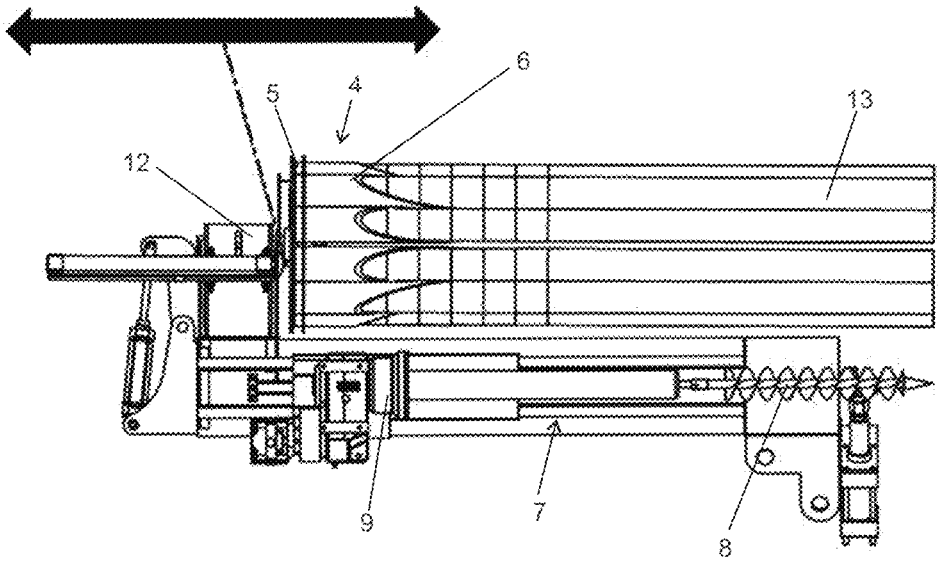
FIG. 12 pictures a front view of the linear movement of the pneumatic installer.

The pneumatic installer 12 is set to "push" the pole 13 against the soil, so that it can enter the hole drilled by the earth auger 7, see FIG. 12. The installer 12 comprises a pneumatic piston, which forces the pole 13 against the hole during installation.

Figure 11:
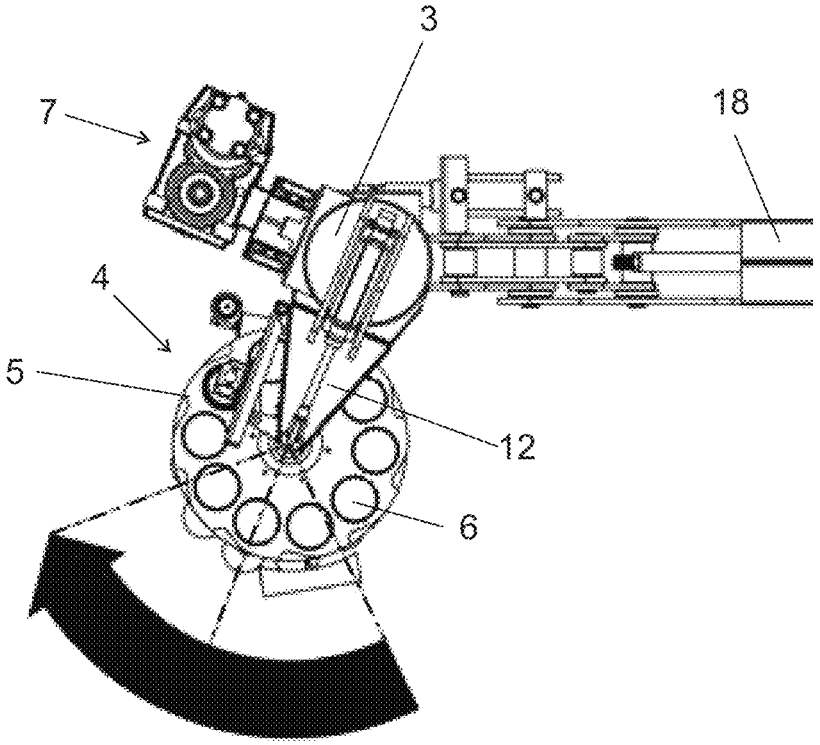
FIG. 11 pictures a top view of magazine rotating.

The pneumatic installer 12 forces only one pole 13 contained in the slot 6 into the ground, at a time, so that rotational movement of the circular base 5 causes other slots 6 to reach the installation point, see FIG. 11. With this, all the poles 13 contained in the slots 6 of the magazine 4 can be installed and the operator does not need to stop to reload the magazine 4 at each installation.

The vehicle for transportation 14 is set to move the earth auger and applicator 10 during installation of the poles 13 and provide part of the power required to earth auger and applicator 10.

Figure 3:
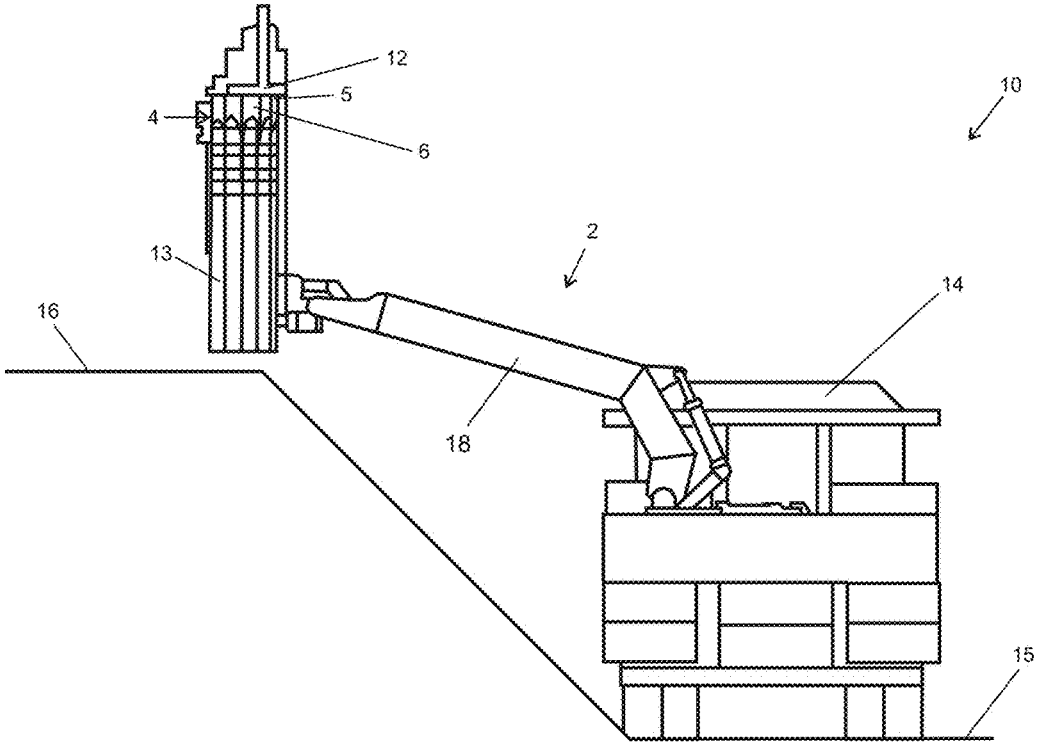
FIG. 3 is a front view of the earth auger and pole machine.
Figure 4:
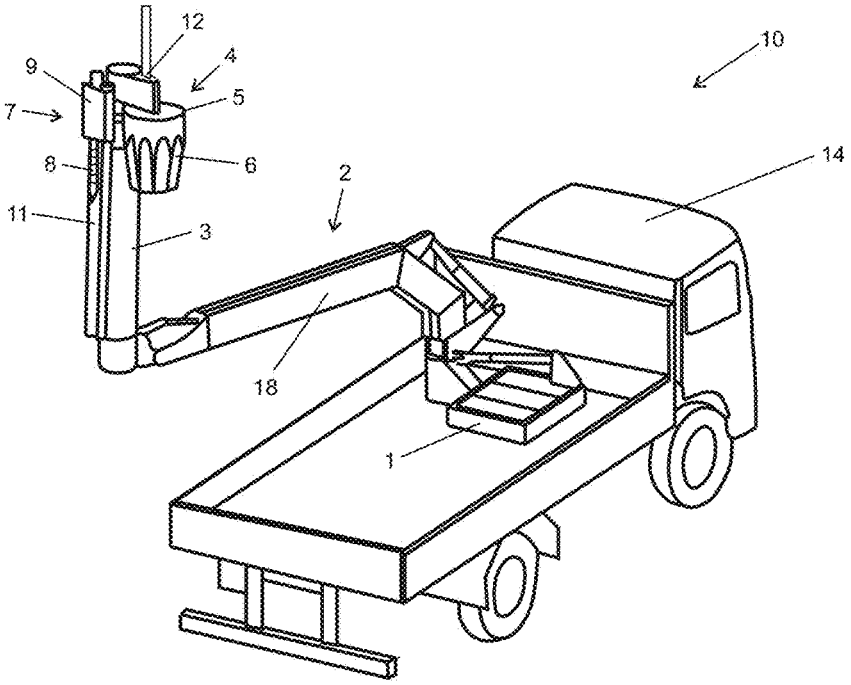
FIG. 4 is a bird's eye view of the earth auger and pole machine.
Figure 5:
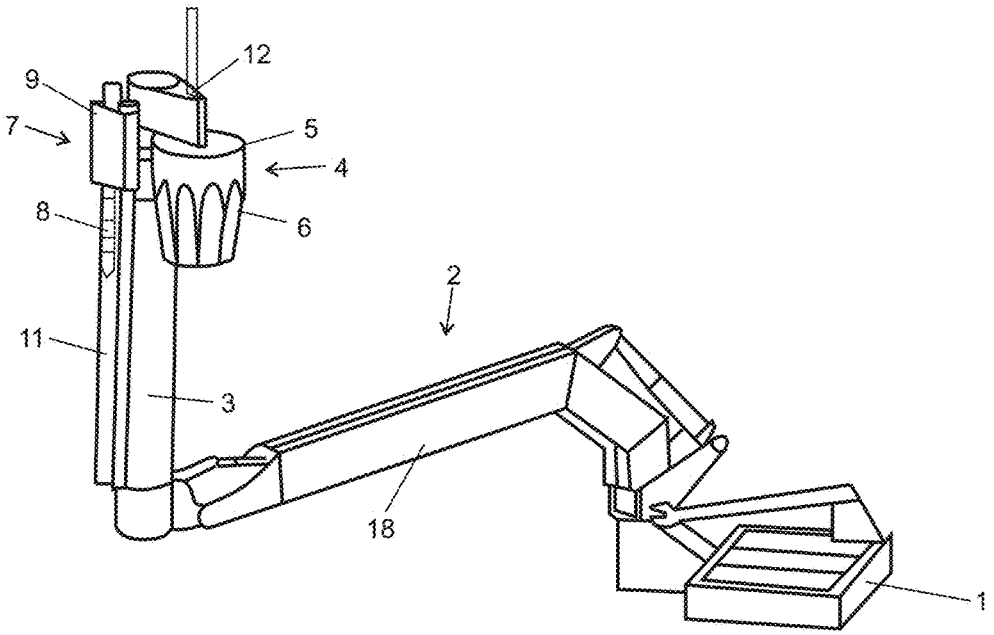
FIG. 5 is a bird's eye view of the mechanical arm and its components.

The earth auger drive and pole machine 10, shown in FIG. 3, is hydraulic and pneumatic. The power that feeds this equipment is obtained from the compressor and power socket comprised of the vehicle 14. There is an electric motor that is individually responsible for turning the magazine 4.

The earth auger and pole machine mechanism 10 comprises eight free degrees, each represented in the figures and pointed out separately below for better understanding.

Figure 6:
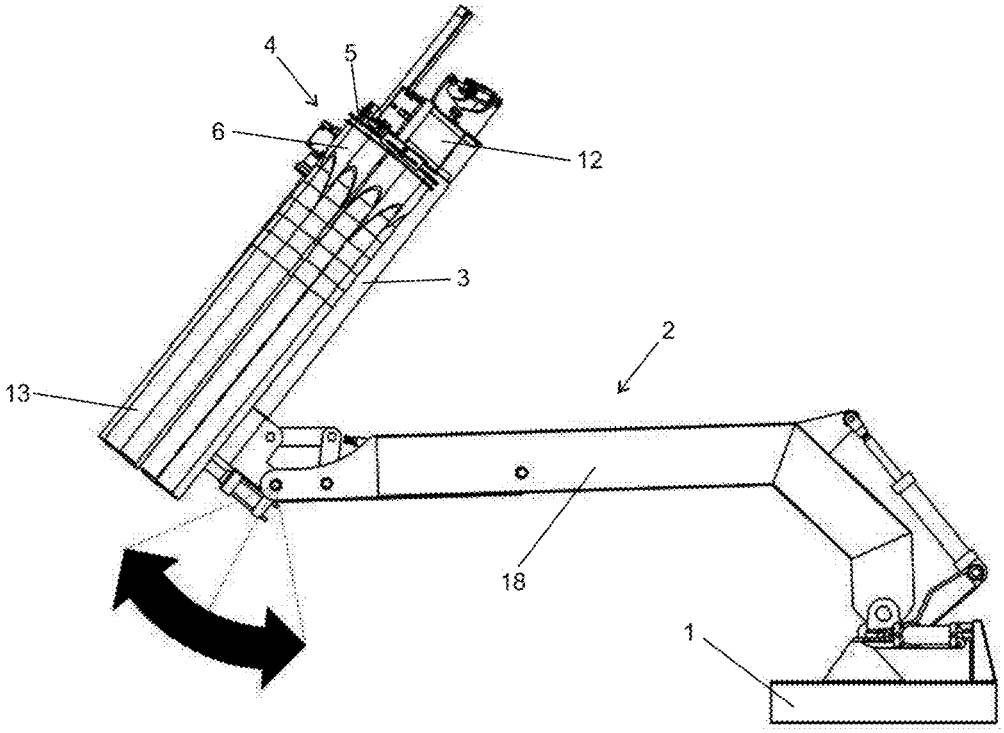
FIG. 6 pictures a side view of the mechanical arm unfolding movement.
Figure 7:
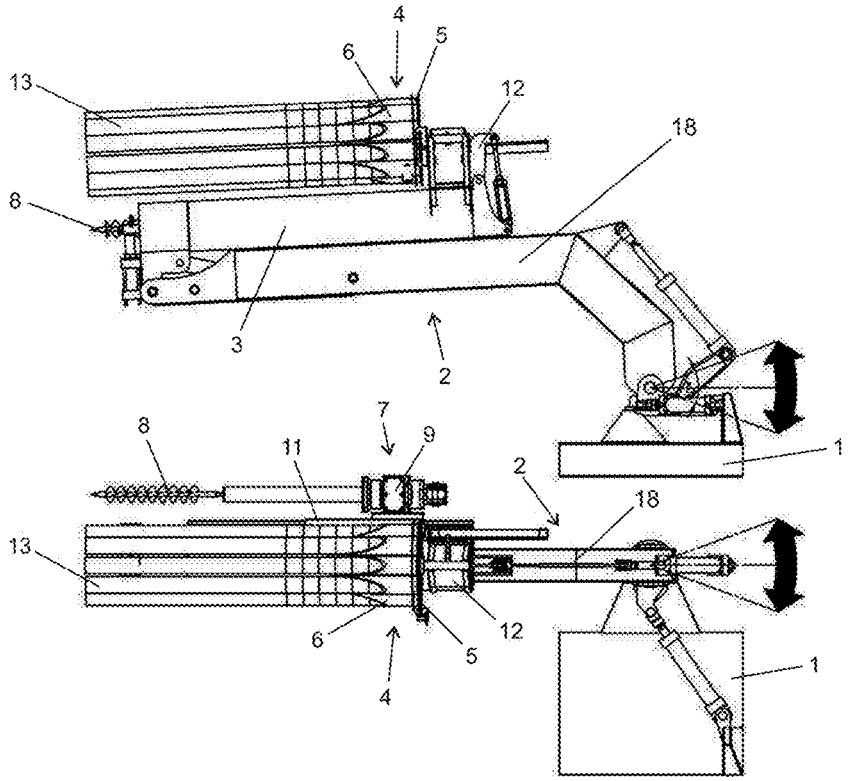
FIG. 7 pictures a side and top view of the movement of the first link of the mechanical arm.
Figure 8:
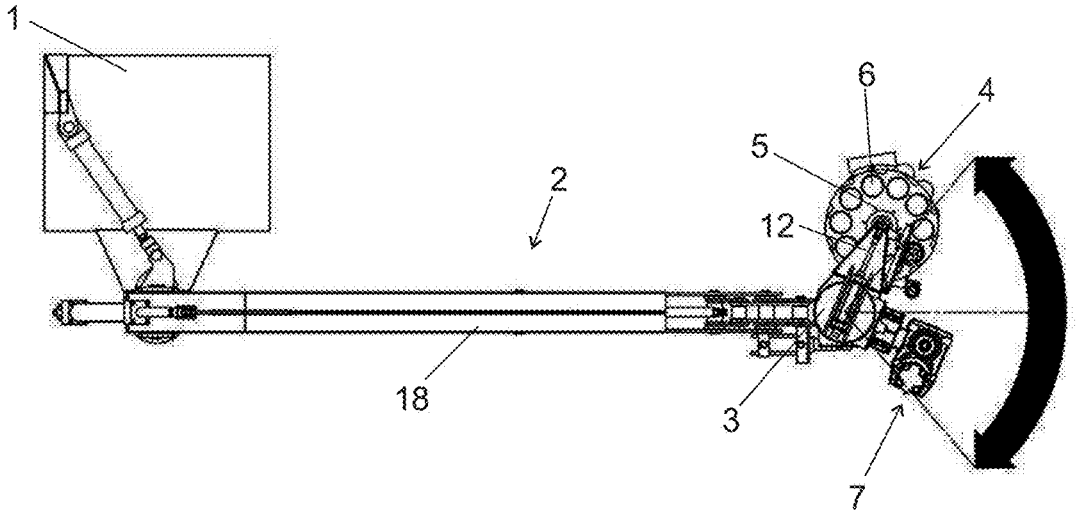
FIG. 8 pictures a side view of rotary displacement of the second link of the mechanical arm.
Figure 9:
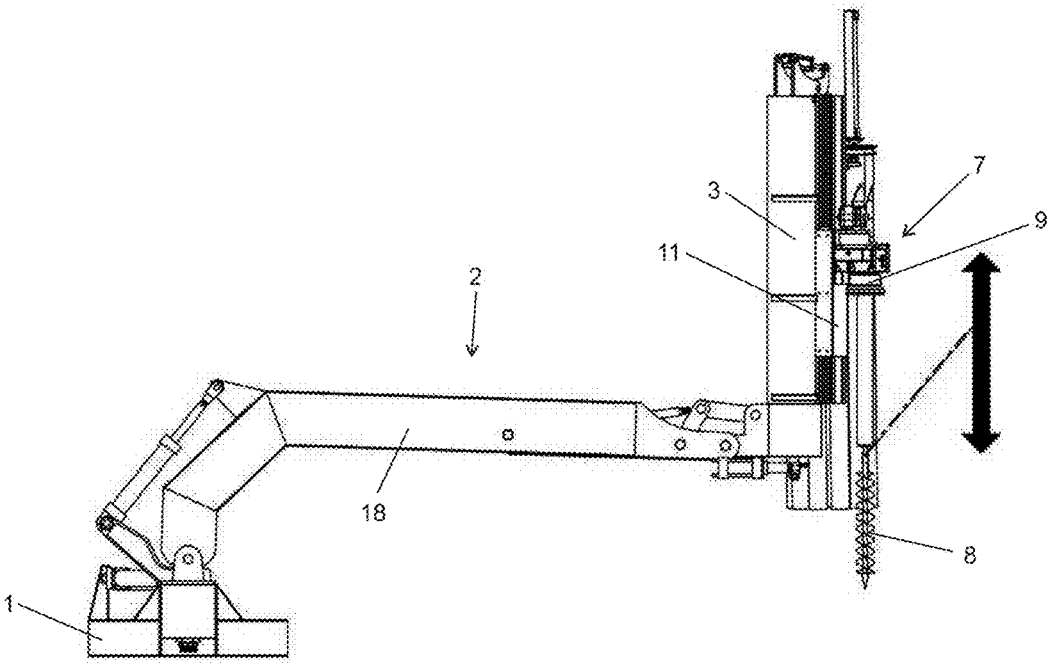
FIG. 9 pictures a side view of the linear movement of the hydraulic auger.

FIG. 6 depicts the unfolding movement of the second link 18 of the mechanical arm 2; FIG. 7 depicts the two movements performed by the first link 18; FIG. 8, the rotation of the second link 3; FIG. 9, the linear movement performed by the hydraulic auger 7; FIG. 10, the opening movement performed by the magazine 4 (this movement is vital to avoid the collision between the magazine 4 and the pole 13 newly installed); FIG. 11, rotational movement carried out by the magazine 4; and FIG. 12, finally, depicts the movement performed by the pneumatic installer 12.

The earth auger and prop road machine 10 also include a command control 17 set to allow the operator to make the installation of poles 13 without having to leave the vehicle 14.

The command control 17 allows controlling the mechanical arm 2 via a joystick, which allows moving it according to its free degrees. This allows precise positioning for installation of poles 13.

The command control 17 also controls the hydraulic earth auger 7, the magazine 4 and the pneumatic installer 12. These, for safety, are only activated when the mechanical arm 2 is already unfolded and positioned in the pole 13 installation location.

The hydraulic earth auger 7 is driven by means of a button contained in the control 17. When the button is pressed, the hydraulic motor is activated causing the auger 8 to start rotating.

The magazine 4 is driven by means of another button contained in the control 17, which is set to drive the electric motor associated with that element, causing the circular base 5 rotate and position the other slot 6 at the installation point.

The pneumatic installer 12 is also driven by means of a button contained in the control 17. This activates the pneumatic cylinder of the installer 12 causing it to force the pole 13 contained in slot 6 placing it in the newly-formed hole in the ground.

Alternatively, the earth auger and pole machine 10 may comprise one or more microprocessors set to coordinate the movements of the links 18, 3 and components 4, 7, 12.

These microprocessors allow, when touching a single button, earth auger and pole machine 10 operator determine the approach of the arm 2, the drilling of the hole, the insertion of the pole 13, the turning of the magazine 4 and the opening defined in FIG. 10.

Still alternatively, the mechanical arm 2 can be bi-parted, so that its length is adjustable by means of a hydraulic cylinder, similarly to a telescopic boom. The turning of the arm 2 can also be performed by a hydraulic motor coupled to a set of worm screw and crown, not limited to a hydraulic cylinder.

The invention also consists of a method for installation of poles 13 in open pit mines 20. Such a method enables poles 13 to be installed in sequence, thus ensuring greater efficiency, comfort and safety during operation.

The method consists of twelve steps, the first step is to load the magazine 4 with up to ten poles 13 by an operator. Such loading is performed by manually inserting the poles 13 in the slots 6 of the magazine 4.

The second step is to move with the earth auger and pole machine 10 to the location where you want to install them. Such move is performed by means of the transportation vehicle 14, which is guided by the operator.

Alternatively, the truck could be automated and set to move to the installation location of the poles by means of a GPS and an autonomous steering system.

The third step is to unfold the mechanical arm 2, causing the second link 3 to reach the top side of the earth bank 16; the fourth step, in turn, consists in positioning the second link 3 above the exact location where you want to install the pole 13.

The fifth step is to activate the hydraulic auger 7 to drill the hole. The activation causes the auger 8 to be rotated by the hydraulic motor coupled to the support 9, which will carry out the linear movement along the rail 11, forcing the auger 8 against the ground and returning it to its original location. This movement will cause the auger 8 to move into and out from the ground, leaving a hole at the location after its withdrawal.

The sixth step is to position the pole 13 on top of the hole through the rotation of the second link 3, as shown in FIG. 8, and then, at the seventh step, the pneumatic installer 12 is activated. The activation causes the installer 12 to apply the required force on the pole 13 so that this moves into the hole drilled in the fifth step.

The eighth step is performing the magazine opening movement 4. This movement prevents the magazine 4 to collide with the pole 13 newly installed.

The ninth step is to activate the magazine 4, so that its circular base 5 perform the rotational movement. This move will have another slot 6 at the installation point.

The tenth step is the movement of the auger and installer 10 to the next pole installation point, continuing the installation sequence.

The eleventh step is to repeat the second until the tenth step until they the poles 13 contained in the magazine 4 are ran out. When all the poles 13 are used, the twelfth step is to restart the method, thus starting from the first step again.

Figure 13:
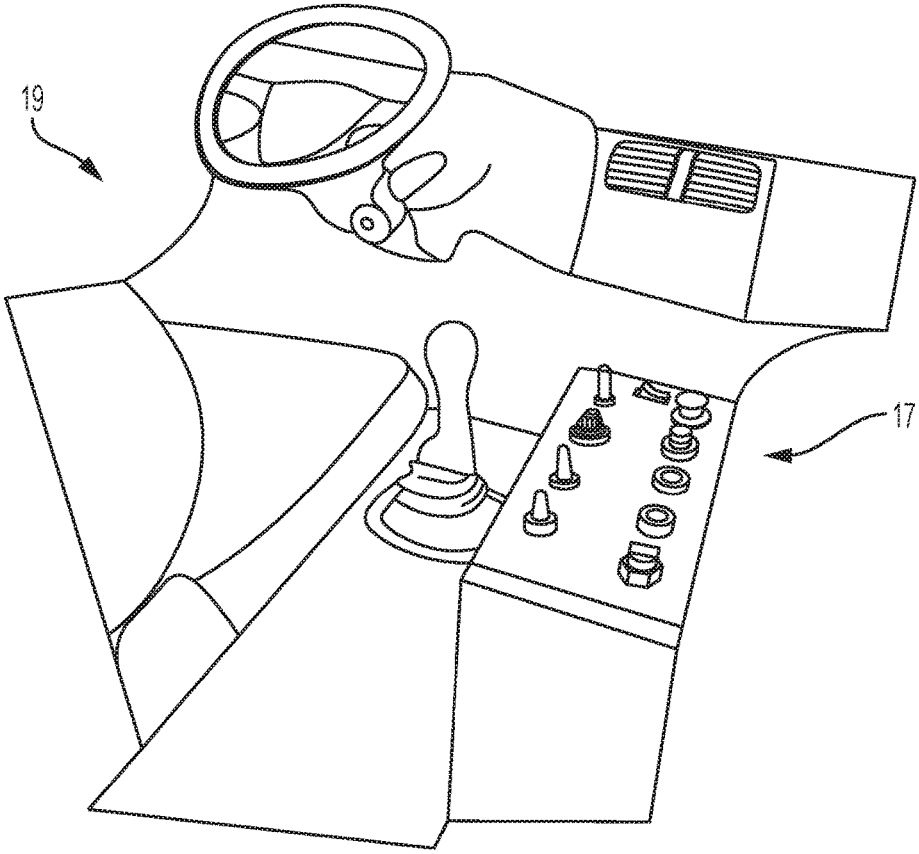
FIG. 13 pictures a bird's eye view to the command control in the recommended settings.

All the third step commands present until the ninth step are performed by means of the command control 17. This, in its preferred configuration, is installed inside the cabin 19 of the control vehicle 14, see FIG. 13. Such positioning allows the operator to perform the installation of poles 13 without leaving the vehicle 14.

In a preferred configuration, the earth auger and pole machine 10 is constituted as shown in FIG. 3. In it, the transportation vehicle 14 used is a road truck and the base 1 is fixed in its body. The magazine 4 has ten slots 6, thus enabling the installation of ten poles 13 before stopping to load. Another detail defined by the preferred configuration of the invention is the inclusion of a mechanical arm 2 provided with eight free degrees.

Although the preferred configuration of the invention defines all these details, it is evident that minor changes to these definitions are not beyond the protection scope of this patent application. Just to mention a few possibilities, the earth auger and pole machine 10 could comprise an arm 2 provided with five free degrees, one magazine provided with four slots 6 and a tractor as a transportation vehicle 14.

The earth auger and the pole machine 10 makes possible a safer and more comfortable installation of poles 13 for the operator. With the use of earth auger and the pole machine 10 and the installation method described herein, it is possible to install multiple poles 13 in sequence without leaving the transportation vehicle 14. This increases the efficiency in installing the poles 13, thus enabling a larger number of installations in a shorter period of time.

Having described some examples of preferred completion of the invention, it is noteworthy that the scope of protection conferred by this document encompasses all other alternative forms appropriate to the implementation of the invention, which is defined and limited only by the claimed table content attached.

The invention claimed is:

1. An earth auger and pole machine having a mechanical arm coupled to a transportation vehicle comprising:

an auger system arranged on the longitudinal side of the mechanical arm;

a magazine connected to the longitudinal side of the mechanical arm and arranged in parallel to the auger system; and an installer arranged on an end of the magazine.

2. The earth auger and pole machine of claim 1, configured to install poles on the upper side of earth banks of open pit mines.

3. The earth auger and pole machine of claim 1, further comprising a moving joint to connect the magazine connection with a link of the mechanical arm.

4. The earth auger and pole machine of claim 1, wherein the installer comprises a piston set to force the pole disposed in one of the slots against the ground.

5. The earth auger and pole machine of claim 1, wherein the transportation vehicle is a road truck.

6. The earth auger and pole machine of claim 1, wherein the magazine comprises slots set to store one or more poles.

7. The earth auger and pole machine of claim 6, wherein the magazine is able to perform a rotational movement of the slots.

8. The earth auger and pole machine of claim 1, wherein the auger system comprises a support and an auger set to drill holes in the ground.

9. The earth auger and pole machine of claim 8, wherein the support is set to perform a linear movement along a rail arranged in the longitudinal side of a link of the mechanical arm.

10. The earth auger and pole machine of claim 1, further comprising a drive that is both hydraulic and pneumatic.

11. The earth auger and pole machine of claim 10, wherein the power which feeds the earth auger and pole machine is obtained from a compressor and a power socket of the vehicle.

12. The earth auger and pole machine of claim 1, further comprising a command control.

13. The earth auger and pole machine of claim 12, wherein the control command is set to control the mechanical arm, the auger system, the installer and the magazine.

14. A method for pole installation using the earth auger and pole machine of claim 1, comprising:

i. loading the poles in the magazine, the magazine comprising slots;

ii. moving the earth auger and pole machine to the installation location by the transportation vehicle;

iii. unfolding the mechanical arm;

iv. placing a second link of the mechanical arm on the desired installation location;

v. activating the auger system for perforating a hole in the ground;

vi. placing the pole over the hole;

vii. activating the installer for insertion of the pole in the hole;

viii. performing an opening movement of the magazine;

ix. activating the magazine for performing the rotational movement of the slots;

x. moving the earth auger and pole machine to the next installation location by the transportation vehicle;

xi. repeating steps iii, iv, v, vi, vii, viii, ix and x until the poles contained in the magazine run out;

xii. returning to step i.

15. The method for pole installation of claim 14, wherein steps iii, iv, v, vi, vii, viii and ix are performed by a command control.

16. The earth auger and pole machine of claim 1, wherein the mechanical arm is provided with moving joints set to support and move it.

17. The earth auger and pole machine of claim 16, wherein the mechanical arm comprises at least eight degrees of freedom.

18. The earth auger and pole machine of claim 16, wherein the mechanical arm comprises a first link and a second link.

19. The earth auger and pole machine of claim 18, wherein the auger system, the magazine and the installer are arranged on the second link of the mechanical arm.

20. The earth auger and pole machine of claim 18, further comprising a base coupling between the first link of the mechanical arm and the transportation vehicle.

21. The earth auger and pole machine of claim 20, wherein the transportation vehicle is a road truck, and the base is coupled to a body of the road truck.

22. An earth auger and pole machine having a mechanical arm coupled to a transportation vehicle comprising:

an auger system arranged on the longitudinal side of the mechanical arm;

a magazine connected to the longitudinal side of the mechanical arm and arranged in parallel to the auger system; and an installer arranged on the magazine, wherein the transportation vehicle comprises a bed and the earth auger and pole machine is capable of installing poles above a height of the bed.

* * * * *